United States Patent [19]

Porter et al.

[11] 4,441,961

[45] Apr. 10, 1984

[54] PULP INSULATED TELECOMMUNICATIONS CONDUCTOR

[75] Inventors: John F. Porter, St. Catharines; Joerg-Heim J. Walling, Beaconsfield; Oleg Axiuk, Pincourt, all of Canada

[73] Assignee: Northern Telecom Limited, Montreal, Canada

[21] Appl. No.: 424,086

[22] Filed: Sep. 27, 1982

[51] Int. Cl.[3] ..... D21D 3/00

[52] U.S. Cl. ..... 162/106; 156/51; 156/56; 427/118

[58] Field of Search ..... 162/106, 267, 268; 118/118, 124; 156/51, 56; 427/118

[56] References Cited

U.S. PATENT DOCUMENTS

| | | | |
|---|---|---|---|
| 2,440,802 | 5/1948 | Krogel | 162/106 |
| 3,525,652 | 8/1970 | Tanaka | 156/51 |
| 4,218,285 | 8/1980 | Durr et al. | 162/106 |
| 4,298,630 | 11/1981 | Kapuscinski et al. | 156/51 |

*Primary Examiner*—Peter Chin

*Attorney, Agent, or Firm*—R. J. Austin

[57] ABSTRACT

A method and apparatus to apply pulp to a telecommunications conductor with an adhesive which is formed from acrylic resin solution. The solution is applied in a bath and is passed between wiping rolls with the feed speed of the conductor and the differential speed between the peripheral surfaces of the wiping rolls and the conductor being controlled together with the contact angle between the conductor and the rolls. This control results in a dried thickness of resin of no greater than 0.00015 inches and as little as 20 microns after further stages in the method. These steps include drying the solution in a solution drying oven, coating the adhesive with pulp and drying the pulp coated conductor. For absolute control of the process, it is preferred for the wiping rolls to be moving in the opposite direction to the conductor at regions of contact with the conductor, for the solution to be prevented from drying as it passes between the wiping rolls, and for there to be continuous relative reciprocating movement between the conductor and the wiping rolls in the axial direction of the rolls.

9 Claims, 9 Drawing Figures

PULP INSULATED TELECOMMUNICATIONS CONDUCTOR

This invention relates to pulp insulated telecommunications conductor.

Pulp, i.e. fibers with a volatile substance in the form of a slurry, is applied to telecommunications conductors to provide, after drying, an insulating layer of fibrous material forming air spaces which assist in giving a desirable low dielectric constant. For convenience, an insulating layer of dried fibrous material formed from pulp will be referred to as a "pulp insulating layer" throughout this specification.

As is known, a pulp insulating layer, when dry, has a low effective dielectric constant which renders it suitable for use in telecommunications cable.

In order to provide a low dielectric constant insulation layer and a compact cable, while resulting in the required mutual capacitance between insulated conductors, i.e. nominally 83 nanofarads/mile in North America, it is necessary that the pulp insulating layer be of low density and as thin as possible. A difficulty associated with the objects of providing low density and reduction in thickness of pulp is that pulp insulating materials tend to be extremely fragile. A pulp insulation layer may become damaged during splicing and also during cable manufacturing operations. The tendency towards becoming damaged increases after the cable has been installed by re-opening an existing splice to perform a resplicing operation.

It has been discovered that if the pulp is caused to adhere to a conductor surface, then this greatly increases the ultimate strength of the pulp and also reduces its tendency to become damaged during splicing or during cable manufacturing operations. For instance, as described in U.S. Pat. No. 4,218,285 entitled "Methods of Pulp Insulating a Conductor" and granted to H. E. Durr and J. G. Wright, Jr. on Aug. 19, 1980, pulp is caused to adhere to a conductor surface by the use of a latex adhesive. The latex adhesive is applied to the conductor and is subsequently dried in an oven before being coated with pulp by dipping the conductor in a pulp bath. The pulp coated conductor is then passed through an oven to dry the pulp. Movement of the conductor through the oven causes the latex adhesive to become tacky whereby the pulp adheres to the latex upon completion of drying and the pulp is therefore held upon the conductor surface.

While the application of a latex adhesive results in achieving the desired object of strengthening the pulp, it does, however, have inherent disadvantages which tend to outweigh the advantages obtained. For instance, latex, by nature, has a low resistance to change while being worked in shear. Because of this, the latex adhesive starts to agglomerate as it is pumped and/or wiped as the adhesive is applied to the conductor. As a result, agglomerated latex accumulates upon surfaces of the apparatus and this affects the total operation of the process as described in U.S. Pat. No. 4,218,285. Latex agglomeration occurs upon rolls which contact the adhesive coated conductor and also within die orifices which are provided to control the adhesive thickness and it is essential for production to cease while the apparatus is cleaned, as mentioned in a paper given to the International Wire & Cable Symposium Proceedings, 1980 and titled "Improved Pulp Insulation For Telecommunications Cable" by H. E. Durr, R. C. Bevens, R. O. Koch and W. M. Flegal. Obviously, this results in the need for intermittent, as distinct from continuous, operation of the apparatus accompanied by lowering of the average speed of throughput of the pulp coated conductor. In addition to this, as the latex adhesive builds up upon the surfaces with which it comes into contact, then during the course of usage after each cleaning operation, the thickness of the adhesive tends to depart from a desired thickness which the dies have been provided to control.

Further as described in U.S. Pat. No. 4,218,285, the process disclosed therein provides a thickness for the adhesive of about 0.005 mm (0.00019") in its dry form. The attainment of thinner layers of dried adhesive, e.g. below 0.0001 inches, is impossible with the process of the patent. This is because conductors tend to vary in diameter along their lengths by a greater extent than the thickness of such a thin layer and thus this variation in diameter would, in combination with the die orifice, give greater variations in thickness of the adhesive than the required thickness itself. In any case, the variation of adhesive thickness when dies are used effects variation in the electrical properties of the insulated conductor. Apart from this, the variation in diameter of the conductor when such a small gap is provided between conductor and die, would result in the conductor becoming jammed in the die in cases where the conductor diameter increased to exceed the nominal for the required gauge. Obviously, this would lead to damage to the equipment and also breakage of the conductors themselves, thereby causing stoppage in production. It is also known that during continuous production, brazed regions to join successive spooled conductors almost invariably have larger diameters than the conductor itself. Apparatus is known for removing weldment or brazed bulged regions in conductor for the purpose of preventing such bulges from causing breakage problems with subsequent processing operations. Notably, a recent U.S. Pat. No. 4,324,515 granted Apr. 13, 1982, and titled "Die Shear Apparatus For Trimming Wire Weld Bulges" in the name of J. W. Ehling, is concerned with the removal of weldment bulges from small diameter wire, e.g. 26 gauge, and wire breakage problems associated with the use of wiping dies for the application of latex in a pulp insulation process are discussed.

While it may be possible if a suitable process is found to provide a thinner layer of latex than is described by the above U.S. patent, it has been determined by the present Applicants, that the apparatus described therein will not allow for a layer of adhesive upon the conductor which is substantially thinner than that quoted by the patent specification. A thickness of 0.005 mm may appear to be negligible, but nevertheless, for at least two reasons, it is excessive. Firstly, the dielectric constant of the adhesive is such that even if such a thin layer is applied to the conductor, then to enable a desired mutual capacitance to be provided between conductors of a twisted pair of conductors, each made according to the process of the U.S. patent, then the resultant pulp thickness needs to be increased beyond that normally required or its density needs to be reduced below that normally provided. The latter requirement is difficult to achieve and would, in any case, result in further weakening of the pulp. Hence, to obtain the desired mutual capacitance, the thickness of the pulp is increased and this results in fewer conductors than normal in a cable of given diameter. For instance, a cable of diameter to be fitted into a 3½" underground duct normally contains up to 3,600 pairs of 26 AWG conductors. A similar diameter cable will only contain a maximum of approximately 2,700 pairs of 26 AWG conductors insulated according to U.S. Pat. No. 4,218,285. Increase in the insulated conductor diameter is considered in the telecommunications field as being a distinct and serious disadvantage because it detracts from a desirable object of increasing numbers of conductors to be passed through the restricted underground ducting space available.

In addition, the thickness of the adhesive is such that it seriously and deleteriously affects the percentage elongation of the conductor before breakage under a tensile load. The reasons for this are twofold. Firstly, the adhesive contributes to the tensile strength of the insulated conductor and restricts the actual elongation of the conductor. Secondly, the adhesive bonds the pulp to the conductor so effectively that under a tensile load, the conductor, adhesive and pulp act as a single tensioned member and are elongated substantially equally. As the pulp is less extensible than the conductor, it breaks at an elongation of from 2% to 5% of its original length (as measured in an atmosphere of 50% relative humidity). As its tensile load increases thereafter, the bond of the pulp to the conductor resists elongation of the conductor at every point except where pulp breakage has occurred; this resistance is so successful that substantially all of the elongation of the conductor takes place at the pulp breakage position. This is explained from page 4 onto page 5 of the above-mentioned paper "Improved Pulp Insulation for Telecommunications Cable". It has been found that this enforced localization of extensibility results in conductor breakage after elongations of between 6% and 8% of the original length. An elongation of 6% is recorded by BTL evaluations in Table I on page 7 of the paper. This result is exceedingly low compared to 20% to 35% elongation found with a bare conductor or a conductor covered with pulp in a conventional manner, i.e. without the use of any adhesive to hold it to the conductor. The paper "Improved Pulp Insulation for Telecommunications Cable" indicates on page 5, second column, that low elongation has caused no problems in the installation or splicing of cables. However, the low degree of extensibility found with the use of latex adhesive is particularly disadvantageous particularly as this may result in increases in conductor breakages during processing after pulp application, by the use of tensile pulling loads to perform such functions as spooling of pulp covered conductor, twisting of conductors into pairs, or during stranding to form cores of twisted conductors.

It is interesting to note that although the above problems are being found with adhesively bonded pulp to conductor, no method, no apparatus and no insulated conductor structure has The present invention provides a method and apparatus for making a pulp insulated conductor, and a pulp insulated conductor in which the above disadvantages are avoided or lessened.

According to one aspect, the present invention provides a method of making pulp insulated telecommunications conductor comprising:

passing the conductor around a roller while immersed in a bath of acrylic resin solution to provide the conductor with a covering layer of said solution;

passing the conductor along its feedpath at a controlled speed and successively into contact with wiping rolls of a series of wiping rolls which are staggered along sides of the path of the conductor while rotating the wiping rolls to provide a differential speed between the rolls and the conductor to create a wiping action, the speed of rotation of the rolls and their distance apart being controlled to determine both the angle of contact with the conductor and the differential speed of the conductor and the rolls to provide, after the further steps in the method, a dried thickness of resin of no greater than 0.00015 inches;

passing the coated conductor through a solution drying oven to dry the coating to make it resistant to migration from the conductor while immersed in a pulp bath downstream of the oven;

coating the adhesive coated conductor with pulp in a pulp bath; and drying the pulp and the adhesive coating, the coating producing a solidified layer which adhesively retains fibers from the pulp upon the conductor.

The above method is applicable to the processing of one conductor only, but is more applicable with commercial advantage to the simultaneous processing of a plurality of parallel and side-by-side travelling conductors.

It should be borne in mind that in the invention as defined above the reference to acrylic resin solution means a solution which is homogeneous at the microscopic level. An acrylic resin solution is a solution where its solubility is by virtue of its pendant acid groups which form a salt in solution with a base which in this case is dilute ammonia. Also solvents could be used such as acetone but these may have problems in manufacturing processes such as pollution and flammability. As distinct from a solution, a latex or an emulsion is an aqueous dispersion of polymer particles stabilised by a small amount of protein and fatty acids (or in the case of synthetic polymer, in a small amount of synthetic soap). A latex is not homogeneous at the microscopic level, but is heterogeneous.

Surprisingly, while no method of applying a layer of adhesive was previously known which would provide extreme thinness to the layer, the applicants have found that the above method steps involving acrylic resin solution will result in a layer thickness no greater than 0.00015 inches and which provides adherence for the pulp to the conductor. Both the method steps and the use of acrylic resin solution are essential to the provision of such an extremely thin layer. For continuous production, it is known in contrast that a dried thickness of such a thin acrylic resin solution adhesive cannot be formed by the use of dies instead of wiping rolls, nor can such a thin layer result from replacing acrylic resin solution with acrylic resin latex and by otherwise following the process steps of the present invention.

Dried acrylic resin solution has a permittivity which tends to be high, e.g. from 3–6, which is comparable to the permittivity of dried acrylic resin latex. While such permittivity is not desirable in the construction of a pulp insulated conductor, the method according to the present invention is able to provide a thickness of 0.0001 inches or less of adhesive, at which thickness any adverse effects caused by the permittivity on the mutual capacitance between pairs of conductors is negligible. However, while latex adhesive has a comparable permittivity to acrylic resin solution, the attainment of such a thin layer of latex is impossible by any known method and cannot be attained by replacing acrylic resin solution with latex in the applicants' process steps of the present invention.

In the process according to the invention with the use of acrylic resin solution as described, it is preferred for the controlled wiping action to be effected by rotating the wiping rolls with their peripheral surfaces travelling in the direction opposite to that of the conductor at positions of contact with the conductor. The controlled wiping contact between the solution on the conductor and the rolls is essential and it has been found that a sufficiently thin layer of the solution may be provided to give the required dried thickness when the speed of the rolls and line speed are controlled. Thus any slippage or variable drag of freely rotatable rolls upon the coated conductor and the resultant variation in wiping efficiency is avoided. The acrylic resin solution is particularly resistant to becoming changed in shear and agglomeration of the solution does not take place.

Also, any variation in conductor diameter has no effect upon the final thickness of the adhesive solution upon the conductor as there is no restrictive orifice, such as a die orifice, through which the conductor has to pass. This adhesive thickness is controlled by other factors, such as the differential speeds between the rolls and the conductor moving along its feedpath and the contact angle between the conductor and the rolls as it passes through the roll series. Other factors which affect the thickness of the adhesive include the viscosity of the solution, the solids content of the solution, the coating surface tension, the number of rolls, and the roll diameter and the tension upon the wire. Also, it has been found that a thickness of dried adhesive may be provided of from between 20 and 100 micro inches, and preferably in the region of between 35 and 60 micro inches. These thicknesses may be provided by using between 10% and 50% by weight of acrylic resin solids in solution. The weight of the solids is preferably between 15% and 30% in solution. The viscosity of the solution should lie within the range of 4 to 50 centipoise. This range is obtainable by variation in the solids content and also by the use of a thickening agent, e.g. a cellulose ether thickening agent, e.g. "Methocel" sold by Dow Chemical Company, or ammonium or sodium polyacrylates, for instance, as sold by Rohm & Haas. At one extreme, 35% solids may be used with no thickening agent, and at the other extreme, 10% solids may be used with up to 0.2% by weight of thickening agent of the total weight of solution. A preferred viscosity is around 8 centipoise and a preferred thickness of dried adhesive is about 50 micro inches.

In a preferred method, the conductor is fed around the rolls, which are disposed in a vertical staggered formation, and immediately upwardly through a vertical drying oven. The use of a vertical drying oven safeguards against any tendency for the low viscosity acrylic resin solution to flow to one side of the conductor and result in bare regions of conductor such as may result if the oven is disposed horizontally. With such a thin layer of material, it is imperative that good overall coverage of the conductor is provided, otherwise any movement of the solution eccentrically of the conductor will result in non-adherence of the pulp along one diametral side of the conductor.

The thin layer of adhesive, i.e. no greater than 0.0001 inches, merely holds inner surface regions of the pulp to the conductor without substantially embedding the pulp fibres in the adhesive. Hence, although the adhesive acts to retain the pulp upon the conductor, it does not cause the tensile strength of the pulp to add unduly to that of the conductor as would be the case if adhesive with a thickness of around 0.00019 inches were used as in U.S. Pat. No. 4,218,285. Thus the percentage elongation at break of conductor having such a thin layer of acrylic resin solution adhesive is advantageously higher than with a thicker layer of adhesive and has been found to lie between 10% and 13% in excess of the original conductor length. This degree of elongation is assisted by the fact that the extremely thin dried adhesive is not a continuous covering surface, but has a multitude of spaced minute holes. During elongation, it is believed that the presence of these holes permits the dried adhesive to stretch by virtue of change in orientation of web like areas between the holes towards the longitudinal direction of the conductor.

The invention also includes an apparatus for applying pulp insulation to a conductor comprising a first bath to contain acrylic resin solution, a first roll rotatable within the bath to feed conductor along its feedpath, beneath the first roll and in the solution and then, in order from the first bath and downstream along the feedpath, a series of wiping rolls extending in staggered relationship along sides of the feedpath, a solution drying oven for drying a layer of acrylic resin solution on the conductor, a second bath to contain pulp for providing a layer of pulp on the conductor, a pulp drying oven for pulp coated conductor, and means for drawing the conductor along the feedpath at a controlled speed, the series of wiping rolls having a drive means to drive each wiping roll at a controlled speed and provide a differential speed between the conductor and the peripheral surfaces of the rolls.

The drive means may be adjustable to adjust the peripheral speed of each wiping roll relative to the speed of the conductor along the feedpath to control the thickness of acrylic resin solution before the conductor moves into the first oven.

In the above apparatus, there is preferably also included a means to adjust the spacing apart of the wiping rolls across the feedpath. Further, in a preferred arrangement, the series of wiping rolls is disposed vertically above the first bath so that the feedpath extends vertically from the bath and the solution drying oven also extends vertically above the series of wiping rolls.

The invention further includes an insulated telecommunications conductor comprising pulp insulation covering the conductor and adhered to the conductor by dried adhesive having a thickness no greater than 0.00015 inches and formed from acrylic resin solution.

One embodiment of the invention will now be described, by way of example, with reference to the accompanying drawings in which.

Figure 1:
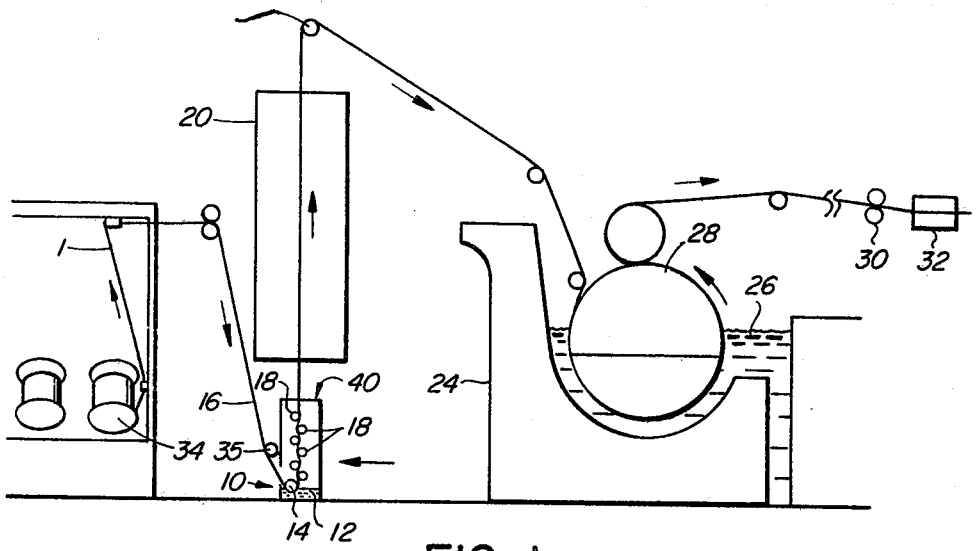
FIG. 1 is a diagrammatic side elevational view of apparatus for coating a conductor with a pulp insulating layer.

As shown in FIG. 1 of the drawings, the apparatus for coating conductor with pulp insulation comprises a first bath 10 containing an acrylic resin solution 12 composed of between 10% and 50% by weight of acrylic resin in water. The actual percentage used in this embodiment is 20% parts by weight of acrylic resin. The viscosity of the solution is about 8 centipiose. The PH of the solution is preferably between 6.8 and 10 and in this embodiment is approximately 7.3 which is alkaline. In this embodiment, "Carboset" resin as made by B.F. Goodrich Chemical Company, according to their designation XL37, is used.

Partly submerged within the solution is a roll 14 around which sixty conductors 16 are passed along parallel paths to submerge them in the solution. One only of the conductors can be seen in FIG. 1. The roll 14 is driven through its end shaft 15 (FIG. 3) with a circumferential speed substantially equal to the speed of conductors through the apparatus.

Figure 2:
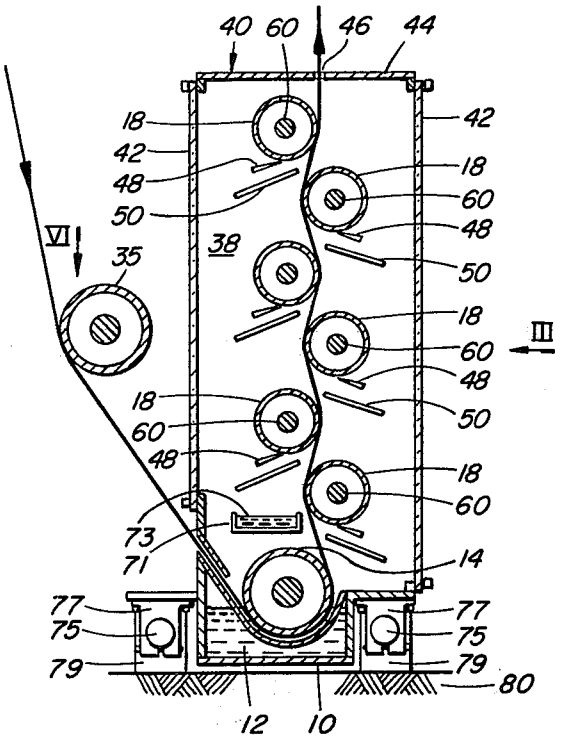
FIG. 2 is a cross-sectional view of part of the apparatus in FIG. 1 but shown on a larger scale.

Downstream along the feedpaths from the roll 14 and within the first bath 10 is disposed a series of six wiping rolls 18 which are driven with the parts of their peripheral surfaces facing across the feedpaths, travelling in the direction opposite to the feedpaths as will be described. The rolls are chrome covered and are disposed three on each side of the feedpaths for the conductors and in staggered relationship from each other. As shown by FIGS. 1 and 2, the feedpaths extend generally vertically between the rolls and then vertically upwardly through a vertical infrared drying oven 20 for drying the solution upon the conductor. From the top end of the oven, the solution coated conductor feedpaths pass around a pulley 22 and then downwardly into a conventional pulp bath 24 containing pulp 26. The pulp is of normal consistency in that it has approximately 0.5% to 1% of fibers dispersed in water. The feedpaths of the conductors then pass around a cylinder mold 28 and over a press roll 30 before proceeding to a drying oven 32 which is of conventional construction.

Figure 6:
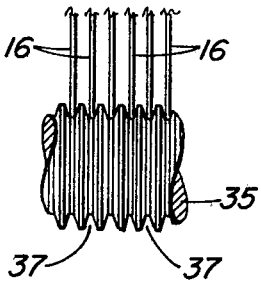
FIG. 6 is a view of one region of the part of the apparatus taken in the direction of arrow VI in FIG. 2.

In use of the apparatus, each conductor 16 is fed from a spool 34 to the bath 10 by means of a guiding roll 35 (FIG. 6). As shown, the roll 35 is formed with annular grooves 37 for fixing the paths of the conductors 16 and for holding them apart. The pulley 22 is similarly grooved. The throughput speed of the conductor, which in this case is 26 AWG, i.e. approximately 0.0159 inches in diameter, is from 150–250 feet/minute and an actual desirable speed is around 220 feet/minute. Tension upon the wire produced by wire pulling mechanisms (not shown) downstream from the oven 32 and in combination with upstream drag produce a wire tension of 400 grams but the tension may be found to be anywhere between 300 and 800 grams. The conductor passes around the roll 14 in the bath 10 and becomes coated with the acrylic resin solution which is at ambient temperature. Then the solution coated conductor passes between the six rolls 18 and contacts each of the rolls around part of its periphery as shown more clearly by FIG. 2. Each of these rolls has a diameter of about 3.875 inches. The roller separation across the feedpath, i.e. the horizontal distance from one roll center to another, is of the order of up to 25% below the diameter of the rolls. The horizontal roll separation may be made variable as will be described. This variation is provided to cause the rolls to contact the conductor over adjustable arcs of contact whereby the wiping length of the rolls upon the conductor may be varied to vary the ultimate thickness of the solution. Of course, the dimensions given above are not critical and dependent upon requirements for arc of contact and the availability of space, the roll diameters may vary between, for instance, 1 and 6 inches with separation distances, for instance in the vertical direction, anywhere between 4 and 15 inches.

Figure 3:
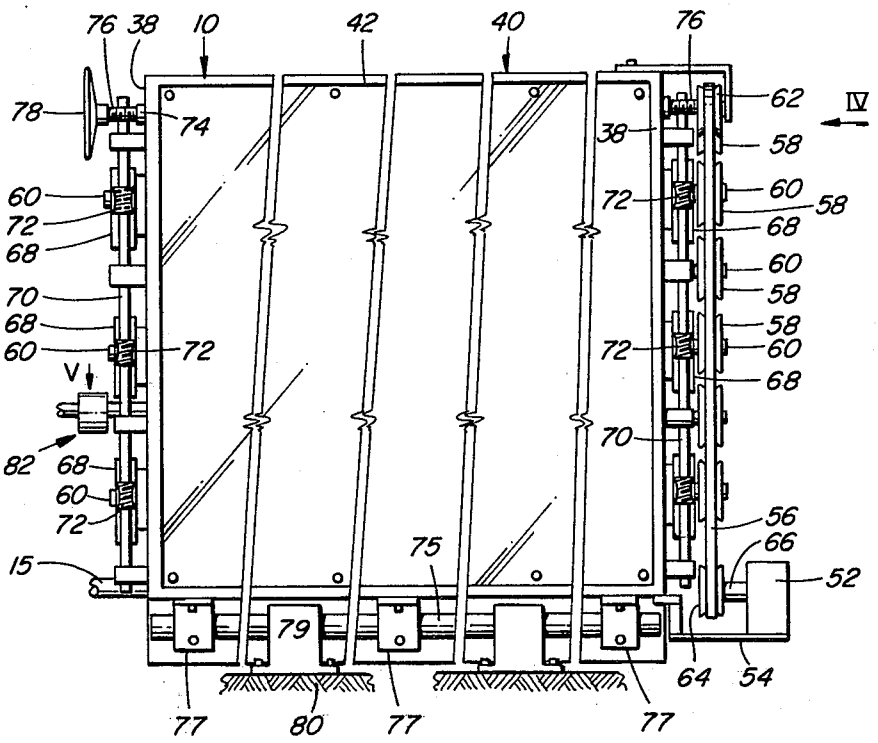
FIG. 3 is a view of part of the apparatus in FIG. 2, in the direction of arrow III.

As may be seen from FIGS. 2 and 3, each of the rolls 18 is rotatably mounted between end plates 38 of a box 40. Two opposite sides of the box are provided by removable transparent panels 42 for visual inspection during operation. The roll 14 is also mounted within the box with the bottom part of the box forming the bath 12. A top 44 of the box has a slit 46 for the clear passage of the sixty conductors out from the box as they move towards the oven 20.

As shown by FIG. 2, each of the rolls 18 is provided with a doctor blade 48 positioned beneath it to remove solution from the roll after the roll has wiped across the conductors. Thus, any part of the surface of each roll 18 is substantially solution fee before returning into contact with the conductors. In addition to the doctor blade 48, each of the rolls 18 has a deflector 50 positioned beneath the doctor blade and this deflector ensures that any solution being removed from a roll, falls outwardly from and does not contact any lower roll before returning to the bath 10.

Figure 4:
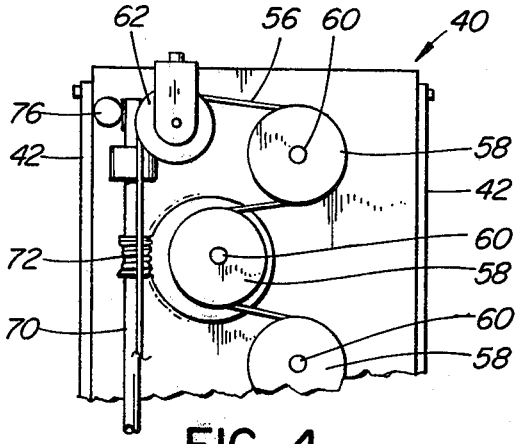
FIG. 4 is a view of one region of the part of the apparatus taken in the direction of arrow IV in FIG. 3.

Drive means is provided for driving all of the rolls 18 so that each roll is driven at a predetermined peripheral speed in the direction opposite to that of the direction of the feedpaths at positions at which its peripheral surface faces across the feedpaths. As shown by FIGS. 3 and 4, this drive means comprises an electric motor and reduction gear 52, mounted upon a platform 54, extending from the base of the box 40. The drive means also includes a rubberized drive belt 56 having driving teeth upon each of its surfaces, and the belt is looped around toothed pulleys 58, secured to drive shafts 60 of the rolls 18. As FIG. 4 shows, the belt 56 extends in one direction around the pulleys 58 on one side of the conductor feedpaths and in the opposite direction around the pulleys on the other side of the feedpaths to drive each of the rolls 18 in the direction opposite to the feedpath direction as is required. The belt extends downwardly from a top idler pulley 62 to a drive pulley 64 mounted upon the drive shaft 66 of the electric motor and reduction gear 52. The driving means ensures that the roll speed is controlled. Control of roll speed together with control of feed speed of the conductors ensures that the relative speed of the wiping rolls and the conductors is constant, thus ensuring that the wiping effect is constant. Constancy in the wiping effect produces a uniform thickness of acrylic resin solution upon each conductor as it moves into the oven 20. The selected speed of rotation and the direction of rotation ensures that a minimum amount of solution is retained upon the conductor and this amount in this embodiment is of the order such as to provide 50 micro inches after drying for the rolls 18 operating at typically between 80 and 100 r.p.m. with a throughput speed of conductor of 220 feet/minute. The rolls 18 operate efficiently in being driven in a direction opposite to the direction of movement of the conductors through the roll series and ensure that a greater wiping action results than would be the case if the rolls were rotating in the same direction as the conductors.

There is also provided a means for varying the horizontal distance between the centres of the rolls from one side of the feedpaths to the other. This distance varying means comprises eccentric mountings for the rotational axes of the rolls on one side of the feedpaths and means to rotate these rolls about their eccentric mountings to move their axes with a horizontal component. Each of the three rolls 18 (one only being shown in FIG. 4), vertically in line and on one side of the feedpaths has its driving shaft 60 eccentrically mounted, at its two ends, within gear wheels 68 which, in turn, are rotatable within the end plates 38. To vary the horizontal distance between rolls, means is provided for rotating all of the gears wheels 68 simultaneously. This rotating means comprises a vertical rotatable shaft 70 at each end of the box 40 (FIGS. 3 and 4) and worm gears 72 on the shafts are engaged with the gear wheels 68. A horizontal drive shaft 74 extends across the top region of box 40 and has end gears 76 drivably connected to both shafts 70. A handle 78 enables drive shaft 74 to be turned to rotate the gear wheels 68 together. This rotation causes a horizontal displacement of the three rolls 18 associated with the gear wheel by movement of the roll axes around the rotational centres of gear wheels 68. A tensioning device (not shown) is provided for the belt 56 to allow for variation in horizontal distance between rolls Disposed above the roll 14 is bath 71 containing heated ionised water 73. The water is heated by a heater (not shown) and is thermostatically controlled between temperature limits suitable for maintaining a desirable humidity level in box 40. In this particular embodiment, the temperature range is between 150° F. and 180° F. A desired humidity level is maintained to prevent the solution on the conductors from commencing to dry while the conductors are passing between the rolls 18. As may be appreciated, the wiping action of the rolls to provide an extremely thin layer of adhesive after drying (which may be as low as 20 micro inches) is critical, and with such thicknesses, any drying of the solution during wiping, would uncontrollably and deleteriously affect the final dried thickness.

Another factor which may lead to variation in thickness of the solution upon the conductors is wear upon the rolls 18 by the conductors. Any wear would result in a groove formation in the roll surfaces and as the grooves develop, this would cause an increasing and possibly uncontrollable variation in the thickness of solution from that desired.

To prevent or resist groove formation in the rolls 18, means is provided for effecting relative movement of the conductors and the rolls 18 in the axial direction of the rolls. This movement is preferably continuous to avoid prolonged contact between each conductor and a fixed axial region of each roll 18 The relative movement effecting means may operate by causing reciprocating axial movement of the guiding roll 35 and pulley 22. The grooves in this roll and pulley decide the feedpath for each conductor and if such a reciprocating movement is effected, the feedpath of each conductor is caused to move axially, backwards and forwards along each roll 18. Alternatively, however, as in this embodiment, the box 40 containing the rolls 18 and roll 14 is reciprocated continuously in the axial direction of the rolls while the guiding roll 35 and pulley 22 are rotated in a stationary position. To effect this movement, the box 40 is mounted upon two spaced and parallel shafts 75, each shaft being secured to the box by three clamps 77. Each shaft 74 is slidable axially within bearings (not shown) retained in housings 79, secured to a fixed machine frame 80.

Figure 5:
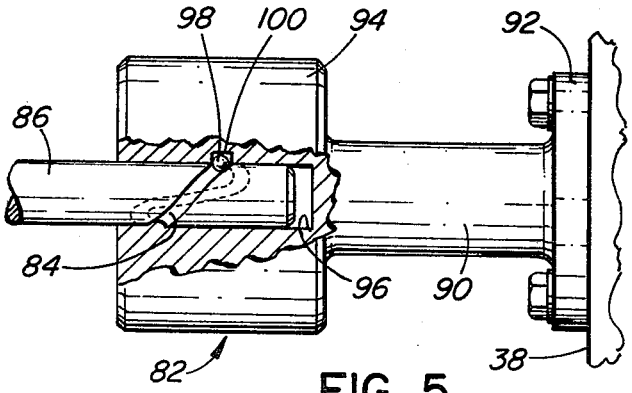
FIG. 5 is a view of one region of the part of the apparatus taken in the direction of arrow V in FIG. 3.

Movement of the box 40 is effected by drive means comprising an electric motor and reduction gear (not shown) and a reciprocating mechanism 82 as shown in FIG. 3 and specifically in FIG. 5. The mechanism 82 comprises a groove 84 formed in the end of the driven shaft 86 of the reduction gear, and a reciprocable groove follower structure 88. The structure 88 comprises a cylindrical member 90, secured by a flange 92 at one end to an end plate 38, and having an enlargement 94 at the other end. This enlargement has a blind bore 96, slidably receiving the shaft 86. A groove follower, i.e. ball 98 received in a fixed position in the bore, i.e. in a recess 100, extends into the groove 84. As shown, the groove 84 is continuous and extends axially and circumferentially of the shaft. Rotation of the shaft 86 within the bore 96 causes the ball 98 to follow the shape of the groove and thus effects axial movement of structure 88 and reciprocating movement of box 40. The shape of the groove 84 and speed of rotation of shaft 86 are such as to reciprocate the box 40 and thus the rolls 18 so that the total axial displacement of each roll 18 is approximately 1.0 inches and the time for this displacement is about one minute. Hence, in use the roll 18 form part of a single movable unit and reciprocate continuously across the conductor feedpaths so as to continuously change the axial position of contact of the rolls with each conductor and thus prevent grooving caused by continued wear from roll contact maintained in one position. The movable unit of the rolls 18 also includes the roll which reciprocates axially with box 40 together with bath 12.

In a modification of the reciprocating mechanism (not shown), the ball 98 is mounted in a recess in the shaft 86 and the groove is formed in the surface of the blind bore 96.

In the oven 20, the acrylic resin solution is dried and fused in order to obtain a uniform essentially water soluble solution. As the conductor passes through the bath 24, it comes into contact with the pulp 26 which is applied to the conductor in conventional fashion by the cylinder mold 28. The conductor then continues with its pulp coating towards the oven 32 with the alkaline pulp slurry in contact with the coating. This contact causes some softening and returning of some of the acrylic resin into solution and, although an extremely thin layer of the resin has been applied to the conductor, some migration of the solution then takes place through the pulp. This is known to be the case in practice, because the press roll 30 eventually becomes covered with the solution as the conductor proceeds across it and the use of a doctor blade is necessary to remove the covering layer. Hence the thickness of the solution on the conductor, as controlled by the rolls 18, is sufficient to provide a general overall thickness of the dried resin upon the conductor (i.e. at approximately 50 micro inches) and also is sufficient to provide additional resin solution for migration through the pulp. Migration of the solution is substantially uniform along the conductor whereby the constancy of the final dried coating is not affected. As the pulp covered conductor passes through the oven 32, it is subjected to contact with air at temperatures between 200° and 500° F. which are provided by infrared heating elements at temperatures between 1000° and 3,000° F. and a preferred temperature in the range of 1,200° F. to 1,600° F.

Figure 7:
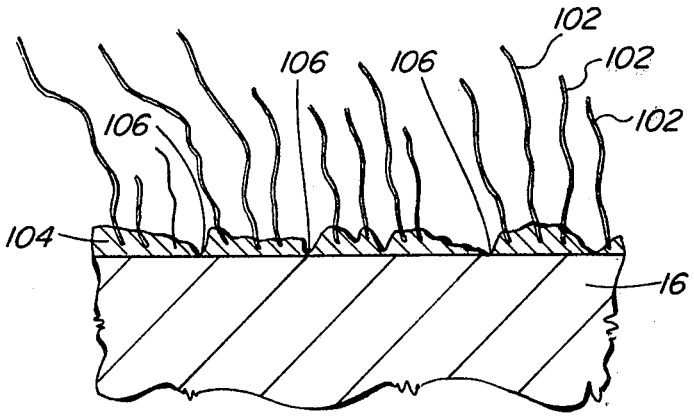
FIG. 7 is a greatly enlarged cross-sectional view through part of a conductor insulated with pulp using the apparatus of the embodiment.

After drying of the coated conductor in the oven 32, the final conductor, in cross-section, is represented by FIG. 7. As shown therein, the conductor 16 is surrounded by the pulp coating 102 and a layer 104 of the dried acrylic resin substantially 50 micro inches in thickness is in contact with the conductor to retain the pulp in place. Although the dried adhesive is extremely thin, there is a significant reduction in tendency for the pulp to become damaged or broken away from the conductor during splicing or during cable manufacturing operations.

A conventional and acceptable tensile test, using an INSTRON extensometer was performed upon this insulated conductor having an outside diameter of pulp sufficient to provide a desired 83 nanofarads/mile mutual capacitance when twisted with a similar insulated conductor and stranded with other pairs. It was found that although the pulp breaks at a percentage elongation under tensile load of between 3 and 5% at 50% relative humidity, the conductor 16 itself does not break under the loading until it has acquired between 10 and 13% extensibility. This indicates that little of the loading is taken by the adhesive itself and that the pulp and adhesive do not unduly restrict extension of the conductor. In fact, the pulp is secured to the conductor to such a minor degree that there is a substantial amount of movement permitted between conductor and pulp at the position of the adhesive. Therefore, extension of the conductor occurs along its length and not solely at the position of pulp breakage. Not only is a negligible tensile strength of the adhesive provided by its extreme thinness, but also it has been discovered, upon examination of finished insulated conductor, that although the adhesive has a general overall coverage of the conductor, it has many pores 106 extending through it to the conductor surface because of its extreme thinness. Thus there is little adhesive at any particular cross-section of the conductor to provide resistance to conductor extensibility.

Figure 8:
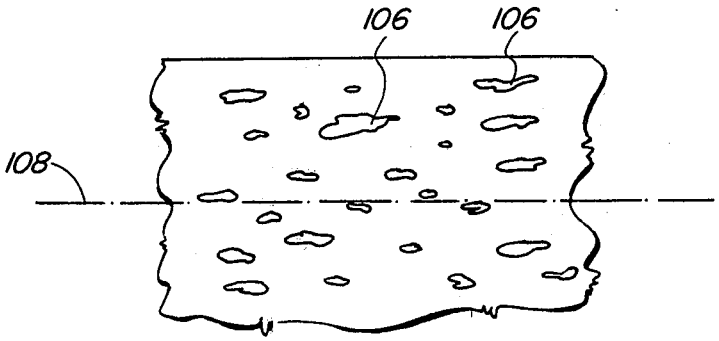
FIG. 8 is a view on a scale similar to FIG. 7 showing the adhesive surface on the conductor after removal of pulp.

FIG. 8 is a sketch showing the surface condition of the adhesive on the conductor surface under magnification. As may be seen, the pores 106 are substantially uniformly distributed, have varying size and tend to be oriented in the direction of the axis 108 of the conductor. This latter feature is believed to be provided by the wiping action of the rolls 18 in the axial direction of the conductor and is significant to the extensibility of the adhesive. The pores 106 convert the adhesive layer into a structure resembling a lattice in which webs of adhesive lying between pores and extending axially of the conductor have insignificant strength, even when attached to the pulp insulation, to resist extension of the conductor. Other webs extending at an angle to the axis tend to orientate axially upon the application of a tensile load. Hence, the adhesive has negligible longitudinal strength while serving its function to retain the pulp upon the conductor.

The area of conductor 16 not covered by the adhesive has been measured in two ways. In a first method, after removal of pulp from a test specimen by dipping the specimen in water to soften the pulp, the adhesive coated conductor was dipped into a solution of sodium sulphide. Upon removal of the specimen from the sodium sulphide, the uncoated regions of conductor had a black surface as the surface material had been changed to copper sulphide. These visible regions which indicated larger pore positions amounted to about 10% of the conductor surface area. By a second method, a pulp coated conductor and a bare conductor were partly immersed in spaced positions in brine water. The non-immersed ends of the two conductors were electrically connected by conductive wire with an ohmeter in the circuit along the wire. From resistance measurements taken by the ohmeter, the area of bare, exposed conductor in the adhesive coated specimen was calculated. This was of the order of 30% of the total are a of immersed part of the specimen.

Figure 9:
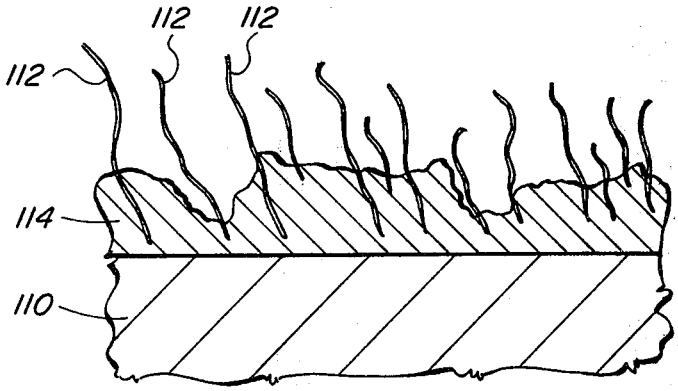
FIG. 9 is a cross-sectional view similar to FIG. 7 of a conductor having pulp insulation applied to it with an adhesive according to a process different from the invention.

In contrast to tests performed on the FIG. 7 conductor, if a 26 AWG conductor 110 (FIG. 9) insulated with pulp 112 and having a layer of latex adhesive 114 as described in U.S. Pat. No. 4,218,285, is tested, under tensile conditions, it is discovered that while the pulp again has percentage elongation of between 3% and 5% before breakage, the conductor itself extends to a degree below that found with the construction built according to the present invention. In the example shown by FIG. 9, the conductor breakage occurred at 6% extensibility. This is undesirable during manufacturing processes on telecommunications conductors. Clearly, with the construction shown in FIG. 9, the adhesive 114 has substantial strength compared with the adhesive layer 104 in FIG. 7 and also secures the pulp fibres more securely to the conductor, whereby the adhesive and embedded pulp fibers reinforce one another. The result of the tensile load upon the FIG. 9 structure is that after breakage of the adhesive and the pulp, the adhesive and embedded pulp at each side of the breakage area resist extension of the conductor so that most extensibility then takes place along the conductor within the region of the severed pulp area. This is as recorded on page 5, FIG. 11 of the paper "Improved Pulp Insulation for Telecommunications Cable" referred to above. Obviously, under these conditions, breakage of the conductor takes place sooner than is the case with the FIG. 7 construction.

Further advantages stemming from the manufacture of the FIG. 7 construction of insulated conductor by the method of the present invention are as follows. The thickness of the adhesive 104 is extremely low and thus while it has a high permittivity, i.e. from 3 to 6, its thickness does not detrimentally affect the electrical properties of the conductor to any substantial extent. Hence, in the construction of FIG. 7, with a 26 gauge conductor designed to obtain a nominal 83 nanofarads/mile mutual capacitance with adjacent conductors in a cable, it is possible to provide 3,600 pairs of conductors in a cable of diameter sufficiently small to pass through a 3½" diameter duct. It has been discovered, however, that with the construction of FIG. 9, because of the thickness of the adhesive 114, the pulp layer 112 needs to be of larger diameter to provide the required nominal 83 nanofarads/mile, thereby reducing the number of pairs in a cable to pass through the same duct to approximately 2,700. It should be noted with this comparison, that the latex adhesive 114 has a permittivity in the same range as the adhesive 104, i.e. between 3 and 6, and therefore the difference in the performance of these two insulated conductors is not caused by the differences between the actual adhesive materials themselves.

Apart from the above advantages, it has been discovered that the above process is the only one which will apply an acrylic resin solution to a conductor at the required thinness. The use of dies to apply the solution is impractical. This is because the normal variation in conductor diameter is greater than the minute clearance required between dies and the conductor surface thus resulting in jamming and conductor breakage. Also during continuous production, brazed regions to join successive spooled conductors almost invariably have larger diameters than the conductor itself. Under these conditions, jamming of the conductor within the dies would result. With the present invention, however, where dies are not used the rolls themselves do not prevent the conductor from moving along its feedpath when the conductor diameter varies and also any variation in conductor diameter has no effect upon the final thickness of the solution applied to it. However, in apparatus using dies, variations in conductor diameter also lead to variation in adhesive thickness because the overall adhesive diameter remains constant. Such thickness variations cause differences to occur in the electrical characteristics of the conductors.

What is claimed is:

1. A method of making pulp insulated telecommunications conductor comprising:

passing the conductor around a first roll while immersed in a bath of acrylic resin solution to provide the conductor with a covering layer of solution;

passing the conductor along its feedpath at a controlled speed and successively into contact with wiping rolls of a series of wiping rolls which are staggered alon sides of the path of the conductor while rotating the rolls to provide a differential speed between the rolls and the conductor to create a wiping action, the speed of rotation of the rolls and their distance apart being controlled to determine both the angle of contact with the conductor and the differential speed of the conductor and the peripheral surface of the rolls to provide, after the further steps in the method, a dried thickness of resin of no greater than 0.00015 inches;

passing the coated conductor through a solution drying oven to dry the coating to make it resistant to migration from the conductor while immersed in a pulp bath downstream of the oven;

coating the adhesive coated conductor with pulp in a pulp bath; and drying the pulp and the adhesive coating, the coating producing a solidified layer which adhesively retains fibers from the pulp upon the conductor.

2. A method according to claim 1 comprising rotating the wiping rolls with their peripheral surfaces travelling in the direction opposite to that of the conductor at positions of contact with the conductor.

3. A method according to claim 2 comprising passing the conductor from the bath of acrylic resin solution, vertically upwards and between the wiping rolls and vertically upwards from the wiping rolls and through the solution drying oven.

4. A method according to any of the preceding claims comprising passing the conductor into contact with the wiping rolls while simultaneously relatively reciprocating the conductor and each wiping roll in the axial direction of the wiping roll.

5. A method according to claim 4 comprising reciprocating each wiping roll in its axial direction to provide the relative reciprocation between the roll and the conductor.

6. A method according to claim 1 comprising maintaining a desired humidity level to prevent drying of the covering layer of solution as the conductor is passed between the wiping rolls.

7. A method according to claim 1 comprising providing a dried thickness of resin between 20 micro inches and 0.00015 inches.

8. A method according to claim 7 comprising providing a dried thickness of resin between 35 and 60 micro inches.

9. A method according to either of claims 7 and 8 comprising providing a thickness of resin which is formed with pores extending through it to the conductor surface.

* * * * *